US010655363B2

(12) United States Patent
Piantek et al.

(10) Patent No.: US 10,655,363 B2
(45) Date of Patent: May 19, 2020

(54) INTEGRATED LOCK BODY SYSTEM FOR SECURING ACCESS POINTS

(71) Applicant: Assa Abloy Inc., New Haven, CT (US)

(72) Inventors: Ryan Piantek, Middletown, CT (US); Richard D. Sangster, Jr., New Haven, CT (US); Scott B. Lowder, Orange, CT (US)

(73) Assignee: ASSA ABLOY INC., New Haven, CT (US)

( * ) Notice: Subject to any disclaimer, the term of this patent is extended or adjusted under 35 U.S.C. 154(b) by 29 days.

(21) Appl. No.: 14/865,180

(22) Filed: Sep. 25, 2015

(65) Prior Publication Data

US 2016/0090753 A1 Mar. 31, 2016

Related U.S. Application Data

(60) Provisional application No. 62/056,068, filed on Sep. 26, 2014.

(51) Int. Cl.
*E05B 39/00* (2006.01)
*E05B 47/00* (2006.01)
(Continued)

(52) U.S. Cl.
CPC ..... *E05B 47/0012* (2013.01); *E05B 47/0001* (2013.01); *E05B 47/026* (2013.01);
(Continued)

(58) Field of Classification Search
CPC ..... E05B 47/0012; E05B 47/0001; E05B 47/026; E05B 47/0673; E05B 47/00;
(Continued)

(56) References Cited

U.S. PATENT DOCUMENTS 3,518,655 A * 6/1970 Saul ..... G08B 13/08 340/507
3,623,087 A * 11/1971 Gallichotte ..... G08B 25/14 340/509

(Continued)

FOREIGN PATENT DOCUMENTS

| | | |
|---|---|---|
| CN | 101807332 A | 8/2010 |
| WO | 9728338 A1 | 8/1997 |
| WO | 20140152240 A1 | 9/2014 |

*Primary Examiner* — Suzanne L Barrett
*Assistant Examiner* — Morgan J McClure
(74) *Attorney, Agent, or Firm* — DeLio Peterson & Curcio LLC; David R. Pegnataro

(57) ABSTRACT

An integrated lock body system for securing access points. An electronic door lock has a lock body, at least one electrical component within the lock to be monitored, and at least one output for connection to an external unit located remotely from the electronic door lock for monitoring load resistance between the external unit and the electronic door lock. A circuit is mounted adjacent to or within the electronic lock body. The circuit includes an electrical connection to the at least one electrical component within the electronic door lock and an external electrical output for connection to the external unit. The circuit further includes at least one resistor between the electrical connection to the at least one electrical component within the electronic door lock and the external electrical output, the at least one resistor imparting a desired load resistance capable of being monitored by the external unit.

20 Claims, 4 Drawing Sheets

(51) Int. Cl.
*E05B 47/06* (2006.01)
*E05B 47/02* (2006.01)
*E05B 45/06* (2006.01)

(52) U.S. Cl.
CPC .... *E05B 47/0673* (2013.01); *E05B 2045/064* (2013.01); *E05B 2045/0615* (2013.01); *E05B 2047/0048* (2013.01); *E05B 2047/0067* (2013.01); *E05B 2047/0071* (2013.01); *E05B 2047/0072* (2013.01); *E05B 2047/0088* (2013.01)

(58) Field of Classification Search
CPC ..... E05B 2047/0048; E05B 2047/0067; E05B 2047/0071; E05B 2047/0072; E05B 2047/0088; E05B 2047/0084; E05B 2047/0068; E05B 2047/0069; E05B 2047/0054; E05B 2047/0093; E05B 39/00; E05B 41/00; E05B 45/00; E05B 45/005; E05B 45/06; E05B 2045/065; E05B 2045/0665
See application file for complete search history.

(56) References Cited

U.S. PATENT DOCUMENTS 3,673,467 A * 6/1972 Eisenreich ..... G07C 9/00007 338/260
3,921,040 A * 11/1975 Clarke ..... G06Q 20/347 340/5.3
4,148,092 A * 4/1979 Martin ..... G07C 9/0069 361/172
4,280,163 A * 7/1981 Osborne ..... G07C 9/00714 361/172
4,465,904 A * 8/1984 Gottsegen ..... H04M 11/04 340/518
4,652,862 A * 3/1987 Verslycken ..... E05B 47/00 109/21
4,663,611 A * 5/1987 Humphrey ..... E05B 45/005 340/426.22
4,848,115 A * 7/1989 Clarkson ..... E05B 47/063 70/276
4,901,057 A * 2/1990 Suneborn ..... E05B 37/00 340/542
4,982,587 A * 1/1991 Tzou ..... E05B 49/004 70/277
5,083,122 A * 1/1992 Clark ..... E05B 47/0012 340/5.22
5,132,667 A * 7/1992 Cranford ..... E05B 37/0037 200/61.67
5,341,124 A * 8/1994 Leyden ..... G08B 13/1454 340/568.4
5,404,735 A * 4/1995 Hsieh ..... E05B 45/005 70/233
5,475,996 A * 12/1995 Chen ..... E05B 47/0692 70/218
5,625,349 A * 4/1997 Disbrow ..... G07C 9/00309 340/5.25
5,656,998 A * 8/1997 Fujiuchi ..... G08B 13/1454 340/568.1
5,701,828 A * 12/1997 Benore ..... E05B 47/0002 109/53
5,841,120 A * 11/1998 Bouthillier ..... G06F 21/34 235/375
5,879,036 A * 3/1999 Moline ..... D06F 37/42 292/210
5,890,384 A * 4/1999 Bartel ..... E05B 81/64 70/264
6,101,856 A * 8/2000 Pelletier ..... E05B 13/101 70/223
6,218,955 B1 4/2001 Conklin
6,330,817 B1 12/2001 Frolov
6,410,854 B1 * 6/2002 Vanhoutte ..... H01R 12/526 174/94 R
6,418,763 B1 * 7/2002 Huang ..... E05B 47/0012 292/144
6,433,678 B1 * 8/2002 Hsieh ..... B60R 25/0225 340/425.5
6,661,333 B1 12/2003 Monnier
6,958,551 B2 * 10/2005 Janssen ..... B60R 25/04 307/10.3
9,705,265 B2 * 7/2017 Lowder ..... H01R 24/28
2002/0154023 A1 * 10/2002 Hazan ..... E05F 15/622 340/686.1
2005/0160777 A1 * 7/2005 Baechle ..... H01H 27/007 70/276
2006/0192396 A1 * 8/2006 Frolov ..... E05B 45/12 292/169
2009/0165513 A1 * 7/2009 Bellamy ..... E05B 47/0011 70/278.7
2011/0203331 A1 * 8/2011 Picard ..... E05B 9/02 70/91
2011/0252843 A1 * 10/2011 Sumcad ..... E05B 47/00 70/91
2012/0001757 A1 * 1/2012 Jung ..... E05B 13/002 340/542
2012/0169453 A1 * 7/2012 Bryla ..... E05B 47/00 340/3.1
2012/0186312 A1 * 7/2012 Lowder ..... E05B 17/22 70/263
2013/0061644 A1 * 3/2013 Trent ..... E05B 47/0012 70/278.7
2013/0067969 A1 * 3/2013 Webb ..... E05B 47/00 70/78
2013/0298616 A1 * 11/2013 Ullrich ..... E05B 47/0012 70/278.1
2013/0298619 A1 * 11/2013 Ullrich ..... E05B 47/0012 70/283.1
2016/0043516 A1 * 2/2016 Lowder ..... H01R 13/465 439/133
2017/0016249 A1 * 1/2017 Johnson ..... E05B 39/00

* cited by examiner

INTEGRATED LOCK BODY SYSTEM FOR SECURING ACCESS POINTS

The present application claims the priority of U.S. patent application Ser. No. 62/056,068 filed on Sep. 26, 2014.

BACKGROUND OF THE INVENTION

1. Field of the Invention

The present invention relates to electronic door locks, and more specifically, to an electronic door lock with resistor network circuitry associated with or located at the lock mechanism.

2. Description of Related Art

Many access control panels available today have the option of continuously monitoring load resistance of their inputs/outputs going to access points, for example, whether a door lock control is open or closed. This system is intended to allow the access control panel to identify if an access point has been tampered with when opened or closed with respect to the resistance values set up in the system. Monitoring of the resistance load is generally done at the load panel. However, the wire run is not typically monitored between the load panel and the door position switch, and current placement of the resistor network, i.e., near the access panel, leaves the line vulnerable to tampering or cutting of the line or shortening of the circuit.

SUMMARY OF THE INVENTION

Bearing in mind the problems and deficiencies of the prior art, it is therefore an object of the present invention to reduce line vulnerability to tampering, cutting or shortening of a monitoring circuit between an access control panel and an access point at a door and electronic door lock.

It is another object of the present invention to provide an improved integrated lock body system to prevent tampering between the load panel and the access point.

It is another object of the present invention to provide heightened security against tampering or defeating access control by having the load resistance at the lock body.

A further object of the invention is to ease and reduce installation time and labor costs for electronic door lock systems.

It is yet another object of the present invention to provide an improved method for determining tampering of an access point in an electronic door lock system.

Still other objects and advantages of the invention will in part be obvious and will in part be apparent from the specification.

The above and other objects, which will be apparent to those skilled in the art, are achieved in the present invention which is directed to an electronic door lock having a lock body and a plurality of outputs for connection to an external unit located remotely from the electronic door lock. The external unit is capable of monitoring load resistance between the external unit and the electronic door lock. The electronic door lock is in electrical communication with the external unit. A plurality of resistors connect between outputs from the electronic door lock and inputs to the external unit, the plurality of resistors embedded in a configurable circuit mounted adjacent to or within the electronic lock body. The configurable circuit includes a plurality of electrical connections extending from a selected set of electrical connection points within the electronic door lock to a selected set of external electrical outputs for connection to the external unit and the plurality of resistors are configured to impart a desired load resistance capable of being monitored by the external unit. The plurality of electrical connections of the configurable circuit and the selected sets of the electrical connection points and the external electrical outputs define a configured interconnection between the selected components within the electronic door lock and the external unit.

In another aspect of the invention, the integrated lock body system may comprise an electronic door lock having a lock body, the electronic door lock being in electrical communication with an external unit. The external unit is located remotely from the electronic door lock and is capable of monitoring load resistance between the external unit and the electronic door lock. A plurality of resistors are connected between outputs from the electronic door lock and inputs to the external unit. The plurality of resistors are embedded in a configurable circuit mounted adjacent to or within the electronic lock body. The configurable circuit includes a plurality of electrical connections extending from a selected set of electrical connection points within the electronic door lock to a selected set of external electrical outputs for connection to the external unit and the plurality of resistors are configured to impart a desired load resistance capable of being monitored by the external unit. The plurality of electrical connections of the configurable circuit and the selected sets of the electrical connection points and the external electrical outputs define a configured interconnection between the selected components within the electronic door lock and the external unit.

In another aspect of the present invention, the integrated lock body system may include an electrical connector key for electrically connecting selected components mounted within the electronic door lock. The electrical connector key has a connector key housing shaped to engage the electronic door lock. The configurable circuit is mounted within the connector key housing. A lock side key connector is mounted to the connector key housing for electrically connecting to the electronic door lock, and the lock side key connector includes a plurality of electrical connection points. The lock side key connector is shaped to electrically connect to a mating lock connector mounted within the electronic door lock when the connector key housing engages the electronic door lock. The connector key housing may be shaped to snap into a mating opening in the electronic door lock.

The plurality of external electrical outputs for connection to the external unit may comprise a plurality of wires and selected wires may be soldered at one end to the configurable circuit to define the selected set of the external electrical outputs. The electrical connector key may communicate with the electronic door lock to identify the electrical connector key as an authorized electrical connector key.

In yet another aspect of the present invention, the configurable circuit may be positioned within a configurable circuit housing mounted adjacent to the electronic lock body and in electrical communication with the electronic door lock. The plurality of external electrical outputs for connection to the external unit may comprise a plurality of wires and selected wires may be soldered at one end to the configurable circuit to define the selected set of the external electrical outputs.

In still another aspect of the present invention, the invention is directed to a method for determining tampering of an access point. Initially, the method provides an electronic door lock having a lock body and a plurality of outputs for connection to an external unit located remotely from the electronic door lock. The external unit is capable of monitoring load resistance between the external unit and the electronic door lock, and the electronic door lock in electrical communication with the external unit. The method also provides a plurality of resistors connected between outputs from the electronic door lock and inputs to the external unit. The plurality of resistors are embedded in a configurable circuit mounted adjacent to or within the electronic lock body. The configurable circuit includes a plurality of electrical connections extending from a selected set of electrical connection points within the electronic door lock to a selected set of external electrical outputs for connection to the external unit. The plurality of resistors are configured to impart a desired load resistance capable of being monitored by the external unit. The plurality of electrical connections of the configurable circuit and the selected sets of the electrical connection points and the external electrical outputs define a configured interconnection between the selected components within the electronic door lock and the external unit. The method also includes monitoring load resistance of the plurality of resistors embedded in the configurable circuit mounted adjacent to or within the electronic door lock body to determine the state of the external unit.

The present invention is also directed to an integrated lock body system for securing access points comprising an electronic door lock having a lock body, at least one electrical component within the lock to be monitored, and at least one output for connection to an external unit located remotely from the electronic door lock for monitoring load resistance between the external unit and the electronic door lock. A circuit is mounted adjacent to or within the electronic lock body. The circuit includes an electrical connection to the at least one electrical component within the electronic door lock and an external electrical output for connection to the external unit. The circuit further includes at least one resistor between the electrical connection to the at least one electrical component within the electronic door lock and the external electrical output, the at least one resistor imparting a desired load resistance capable of being monitored by the external unit.

The electronic door lock may have a plurality of outputs for connection to the external unit. The integrated lock body system may further include an external unit located remotely from the electronic door lock and capable of monitoring load resistance between the external unit and the electronic door lock, the electronic door lock being in electrical communication with the external unit.

The circuit in the integrated lock body system may be a configurable circuit including a plurality of electrical connections extending from a selected set of electrical connection points within the electronic door lock to a selected set of external electrical outputs for connection to the external unit. The circuit may include a plurality of resistors able to be configured to impart a desired load resistance capable of being monitored by the external unit. When the external electrical outputs are connected to the external unit the plurality of electrical connections of the configurable circuit, the selected sets of the electrical connection points and the external electrical outputs may define a configured interconnection between the selected components within the electronic door lock and the external unit. The plurality of resistors may be embedded in the circuit.

The integrated lock body system may further include an electrical connector key for electrically connecting selected components mounted within the electronic door lock. The electrical connector key may have a connector key housing shaped to engage the electronic door lock, with the configurable circuit mounted within the connector key housing. A lock side key connector may be mounted to the connector key housing for electrically connecting to the electronic door lock. The lock side key connector may include a plurality of electrical connection points. The lock side key connector may be shaped to electrically connect to a mating lock connector mounted within the electronic door lock when the connector key housing engages the electronic door lock. The connector key housing may be shaped to snap into a mating opening in the electronic door lock. The electrical connector key may communicate with the electronic door lock to identify the electrical connector key as an authorized electrical connector key. The plurality of external electrical outputs for connection to the external unit may comprise a plurality of wires, and the selected wires may be soldered at one end to the configurable circuit to define the selected set of the external electrical outputs.

The present invention is also directed to a method for determining tampering at an access point. The method includes providing at the access point an electronic door lock having a lock body, at least one electrical component within the lock to be monitored, and at least one output for connection to an external unit. The method also provides a circuit mounted adjacent to or within the electronic lock body. The circuit includes an electrical connection to the at least one electrical component within the electronic door lock and an external electrical output for connection to the external unit. The circuit further includes at least one resistor between the electrical connection to the at least one electrical component within the electronic door lock and the external electrical output, the at least one resistor imparting a desired load resistance capable of being monitored by the external unit. The method further includes providing an external unit located remotely from the electronic door lock and capable of monitoring load resistance between the external unit and the electronic door lock, with the electronic door lock being in electrical communication with the external unit. The method then includes monitoring load resistance of the at least one resistor in the circuit mounted adjacent to or within the electronic door lock body to determine the state of the electronic door lock at the external unit. The monitoring may determine change to a resistance value established for the at least one electrical component within the electronic door lock.

The circuit may be a configurable circuit including a plurality of electrical connections extending from a selected set of electrical connection points within the electronic door lock to a selected set of external electrical outputs for connection to the external unit. The circuit may include a plurality of resistors able to be configured to impart a desired load resistance capable of being monitored by the external unit. The method may include configuring the circuit so that the plurality of electrical connections of the configurable circuit, the selected sets of the electrical connection points and the external electrical outputs define a configured interconnection with a desired resistance load between the selected components within the electronic door lock and the external unit.

The method may also include mounting the circuit within the electronic lock body or adjacent to the electronic lock body.

The method may further include providing an electrical connector key for electrically connecting selected components mounted within the electronic door lock. The electrical connector key may have a connector key housing shaped to engage the electronic door lock, the circuit mounted within the connector key housing. The method may then include providing a lock side key connector mounted to the connector key housing for electrically connecting to the electronic door lock. The lock side key connector may include a plurality of electrical connection points. The lock side key connector may be shaped to electrically connect to a mating lock connector mounted within the electronic door lock when the connector key housing engages the electronic door lock. The method may further include placing the connector key housing into a mating opening in the electronic door lock to electrically connect the electronic door lock with the external unit. The electrical connector key may communicate with the electronic door lock to identify the electrical connector key as an authorized electrical connector key.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
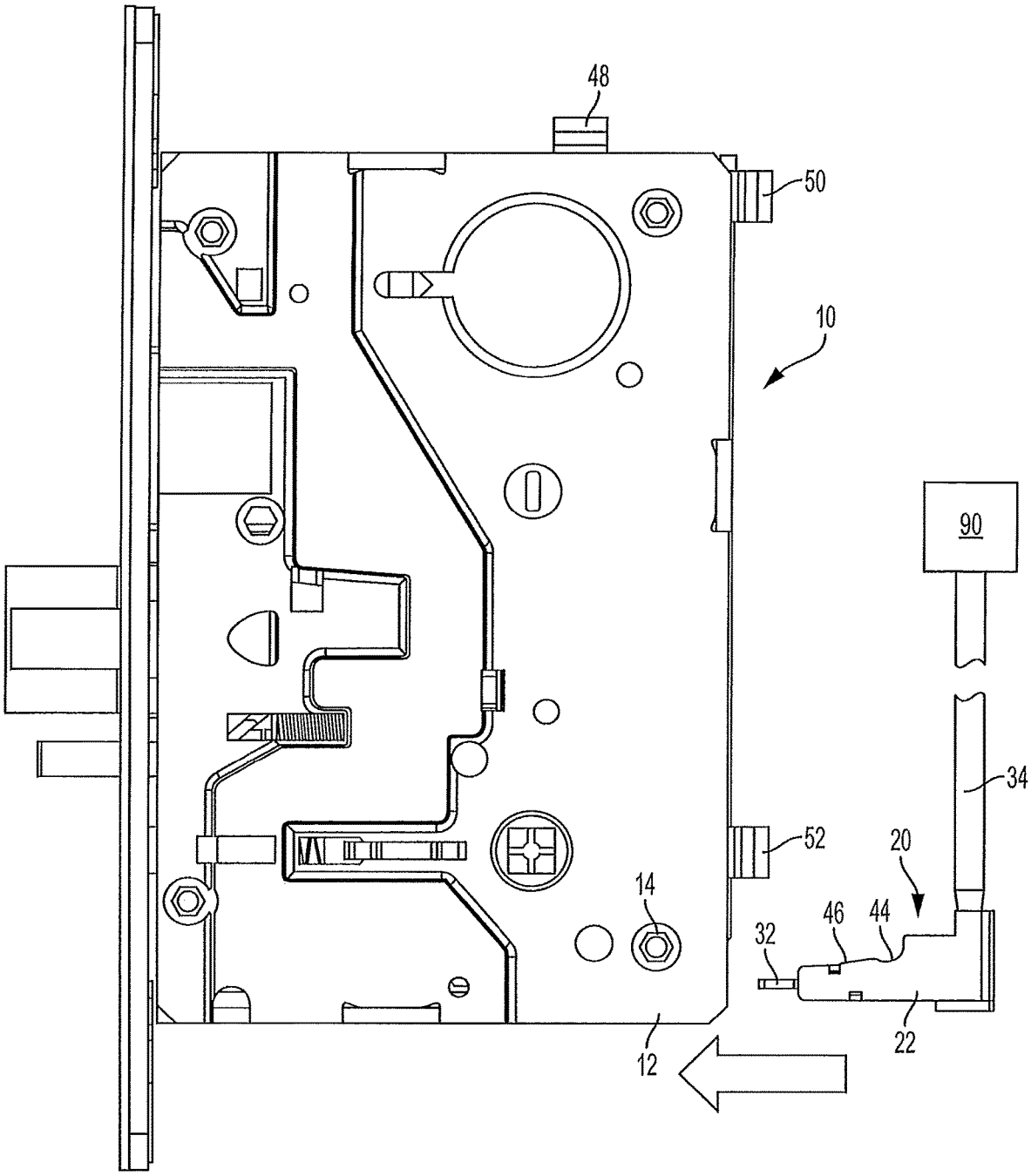
FIG. 1 is left side elevational view of the electrical connector key of one embodiment of the present invention ready for connection to a mortise lock in the direction of the arrow.

In describing the embodiments of the present invention, reference will be made herein to FIGS. 1-9 of the drawings in which like numerals refer to like features of the invention.

The present invention is directed to an electronic door lock system in which the electronic components within the lock are electrically connected to an external unit located outside the lock, such as an access control panel. Such electronic components may be sensors positioned in the interior of the door lock body and may be contact switches, magnetically operated reed switches, Hall effect sensors and/or other types of sensors. Such sensors may be located to signal the position of mechanical components within the lock and/or the door. The sensors may be used to indicate whether the door lock is in the locked or unlocked state. They may indicate if the latchbolt is extended or retracted, or whether the door on which the lock is installed is open or closed. They may monitor the position of a deadbolt, the rotation of a handle or signal whether the lock has performed other functions. The connection from the lock to the access control panel is typically made with wires that connect through a wiring harness to the access control panel.

The electronic door lock system may be configured to permit detection of tampering by allowing an external device, such as an access control panel, to monitor load resistance based upon a customized and installed resistor network circuitry configuration, which is typically installed in the wire near the access control panel. The configuration of the resistor network circuitry will indicate the state of the device, for example, whether the door lock control is open or closed, based on the set resistance values.

The access control panel may continuously monitor load resistance of their inputs/outputs going to access points such as sensors in or on the electronic door locks and/or the doors. This system allows the access control panel to identify if an access point has been tampered with when opened or closed with respect to the resistance values set up in the system, and monitoring of the resistance load is generally done at the load panel. Typically, the wire run is not monitored between the load panel and the door position switch. To prevent the possibility of tampering, the system of the present invention avoids placement of the resistor network near the load panel, which would leave the line vulnerable to tampering, cutting or shortening of the circuit, by placing end-of-line resistors as close to the contacts (mechanical switch or reed switch) as possible. The closer the resistor network is to the contact, the less likely it is that the monitoring can be defeated. The most secure positioning would be to integrate the resistors within the lock body.

The present invention provides heightened security against tampering or defeating access control by having the load resistance associated with or located at the lock mechanism, which will decrease the ability to tamper with the line. Access control manufacturers have created multiple resistance networks for their unique systems, the most common being a one thousand ohm (1 KΩ) (door is closed) to two thousand ohm (2 KΩ) (door is open) solution, which is utilized in over fifty percent (50%) of applications. In this solution, the load resistance will go to infinite ohms (∞Ω) if the line is cut, or drop to zero ohm (0Ω) if the circuit is shorted. The present invention allows for the design option ability of an integrated printed circuit board that will incorporate the ability to compliment access control panels that continuously monitor lock function states at set resistance values, and can be easily adapted to be compatible with any access control manufacturer's unique resistance network.

FIGS. 1-5 show one embodiment of the present invention, wherein a configurable circuit board with embedded resistor network is enclosed within an electrical connector key which engages with the electronic door lock body. Referring to FIG. 1, an electrical connector key 20 according to the present invention is provided to make connection to selected electrical components mounted within an electronic door lock 10. The electrical connector key 20 includes a connector key housing 22 shaped to be insertably mounted within the electronic door lock 10.

The connector key housing 22 may be formed in two halves 24, 26 (see FIG. 4) that surround a configurable circuit 30. In the embodiment shown, one end of the configurable circuit 30 is a card edge connector forming a lock side key connector 32. Within the connector key housing 22, the configurable circuit 30 makes connection between multiple connection points along the card edge connector 32 and wires forming cable 34.

Connector key housing halves 24, 26 each have an aperture portion 33*a*, 33*b*, respectively, that when combined form an aperture for surrounding cable 34 in a press-fit fashion. Cable 34 may form part of the external wire harness and lead to an external unit 90, and the cable may send and/or receive electrical signals passing between electrical components in the electronic door lock 10 and the external unit. Cable 34 may be secured to the mortise lock by a plurality of cable clips, such as cable clips 48, 50 and 52. The cable may place the electronic door lock in electrical communication with the external unit, and the external unit may be located remotely from the electronic door lock, for example in an otherwise conventional access control panel, for monitoring load resistance between the external unit and the electronic door lock.

Figure 2:
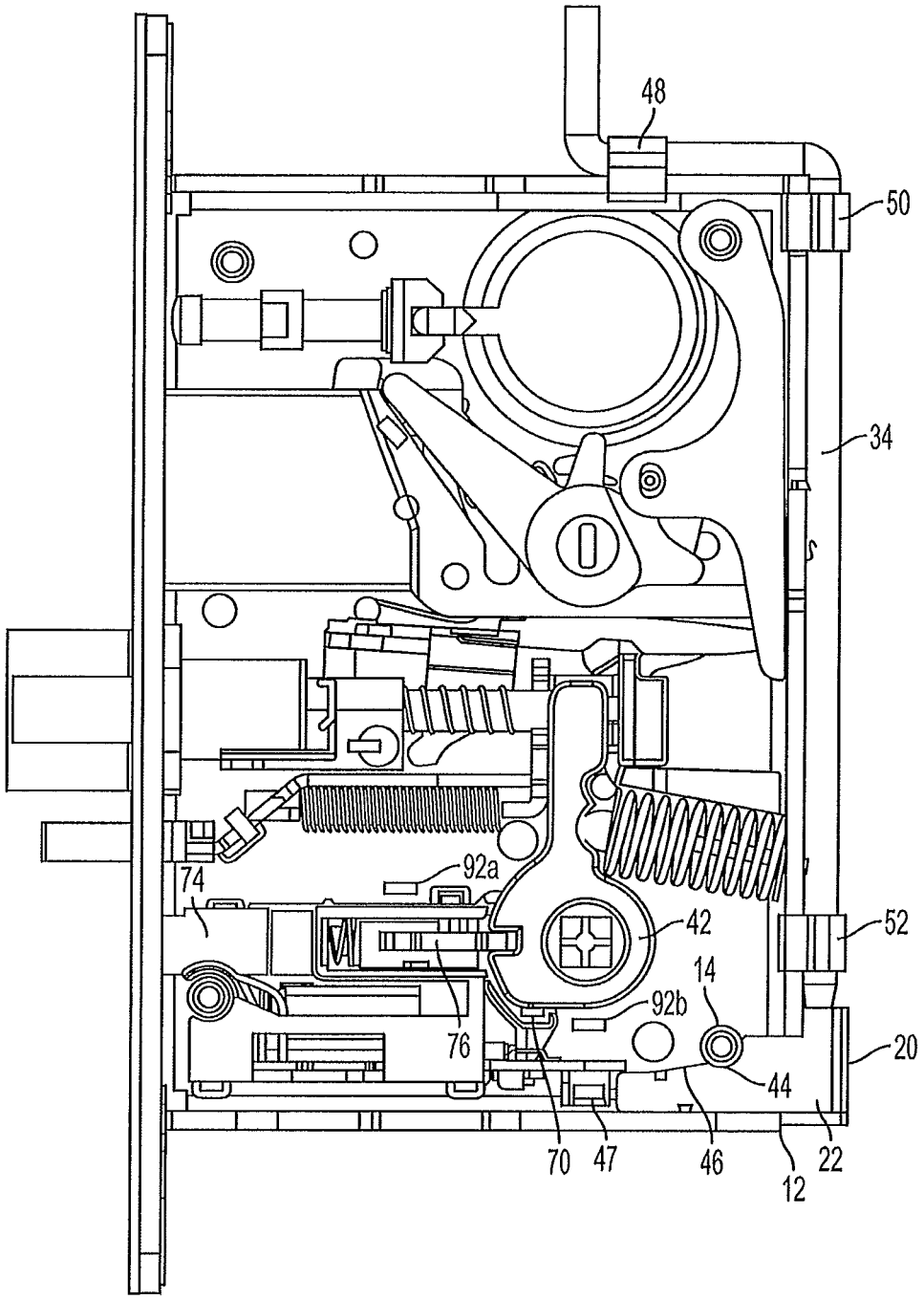
FIG. 2 is a left side elevational view of the electrical connector key of one embodiment of the present invention inserted into the mortise lock shown in FIG. 1.
Figure 3:
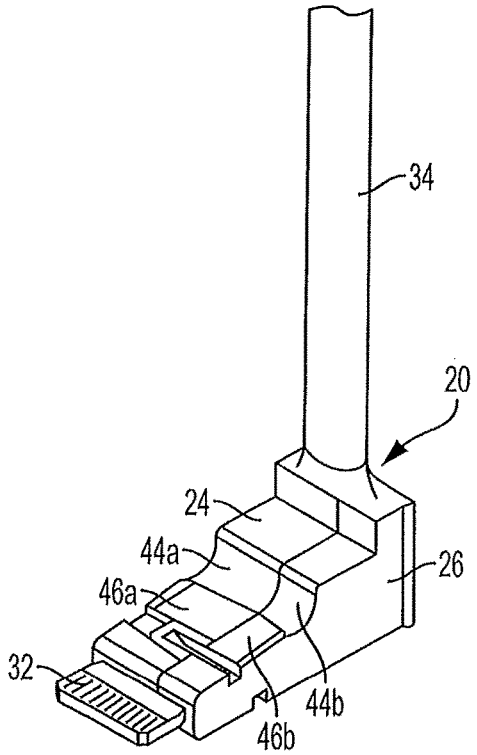
FIG. 3 is a perspective view of the electrical connector key of one embodiment of the present invention.

In FIG. 2, the cover plate of the mortise lock has been removed to show internal lock components, sensors and actuators and to better show how the electrical connector key of the present invention engages the mortise lock. FIG. 2 shows the electrical connector key 20 inserted into a corresponding opening 12 in the lower right corner of the mortise lock 10. As also shown in FIG. 3, each half 24, 26 of the connector key housing 22 is provided with a notch or groove 44*a*, 44*b*, together forming groove 44, and a ramp surface 46*a*, 46*b*, together forming ramp 46. As the electrical connector key 20 is inserted into opening 12, the ramp surface 46 contacts and slides under a stud 14 in the interior of the mortise lock 10. The electrical connector key 20 may snap into a desired position as the groove 44 reaches the stud 14, and the stud removably locks into the groove. The electrical connector key may be shaped so that the rear portion of the connector key housing does not extend beyond the edge of the mortise lock body when inserted and mounted within the mortise lock body. The wires within cable 34 exiting the electrical connector key 20 may be connected directly to an external unit 90 (FIG. 1), such as an access control panel, or may be attached to an intervening electrical connector.

Also, as the electrical connector key 20 is inserted, the card edge connector forming lock side key connector 32 may engage lock connector 47. Connector 47 has multiple individual connectors conforming respectively to the multiple connection points along the card edge of lock side key connector 32. These individual connections between connector 47 and lock side key connector 32 electrically connect the circuit board 30 of the connector key 20 to the electrical components such as reed switch sensor 92*a*, that senses movement of locking piece 76 driven by motor 74 into or out of locking engagement with spindle hub 42 via a magnet (not shown) integral with or mounted on locking piece 76, and reed switch 92*b*, that senses the position of spindle hub 42 via magnet 70 mounted thereon. Connector 47 or some other type of electrical connection may be made to electrical components used to sense the position of these and various other mechanical components within the mortise lock 10. By configuring the electrical connections provided on the configurable circuit board 30, different wires within cable 34 may be connected or not connected.

Figure 4:
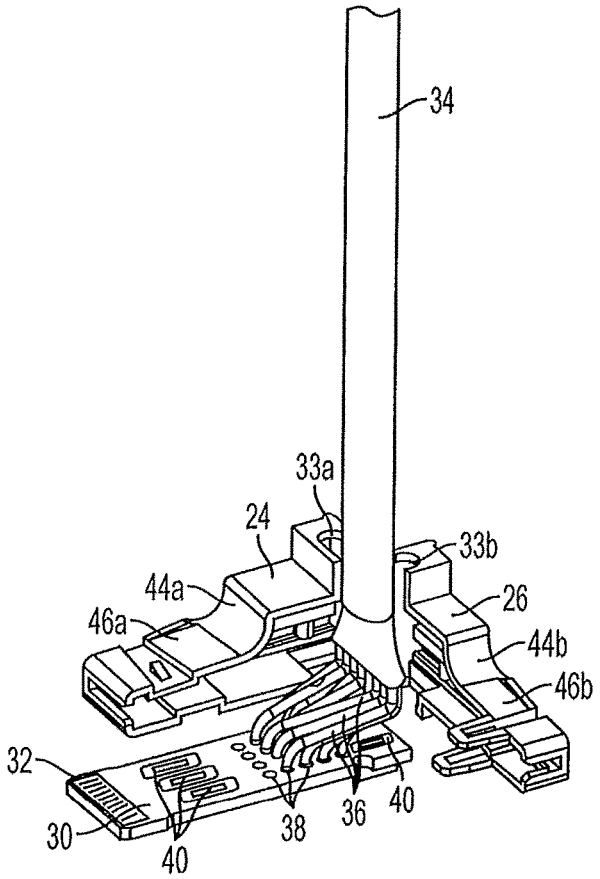
FIG. 4 is an exploded perspective view of the electrical connector key in FIG. 3.
Figure 5:
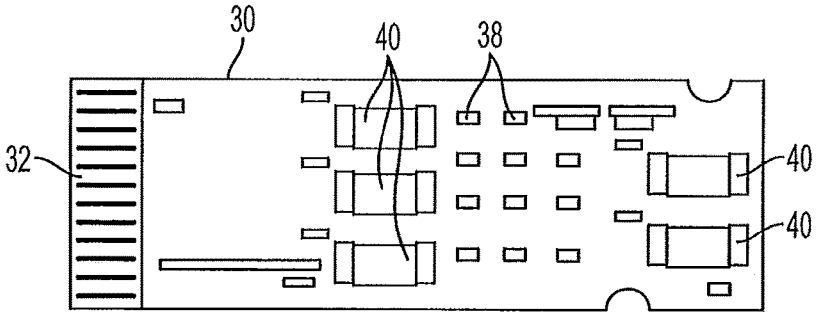
FIG. 5 is a plan view showing the configurable circuit mounted within the connector key housing.

Referring to FIGS. 4 and 5, configuration of the key may be achieved simply by connecting or not connecting wires 36 in cable 34 to corresponding solder points 38 on circuit board 30. Alternatively, circuit board traces (not shown) which interconnect the various components on the circuit board 30 may be omitted or added to achieve the desired configuration. Further, the circuit board 30 may be provided with various cross connections, or with additional electrical components to achieve the desired configuration.

Additional electronic components may be mounted on the circuit board 30 to identify to circuitry in the lock and/or the external unit what type of electrical connector key has been installed and/or to signal that a valid and authorized electrical connector key has been installed, and/or to impart a desired load resistance which can be monitored by the external unit to determine its state. In the embodiment shown in FIGS. 4 and 5, electronic components in the form of resistors 40 have been embedded in the circuit board 30, which resistors provide a desired load resistance that can be monitored by the external unit. These end-of-line resistors can be used individually or may be configured by omitting or adding electrical connections therebetween to achieve the desired load resistance. The particular embedded circuit board configuration may be adapted to be compatible with any access control manufacturer's unique resistance network. By integrating the resistor network in circuit 30 within the lock body in this manner, it decreases the possibility of tampering with the line, absent removing the mortise lock cover plate as well as connector key housing 22 to access the circuit board 30. Different circuit boards, including different embedded resistor networks, may be used to achieve different desired connections or wires may be selectively connected to enable desired interconnections.

Figure 6:
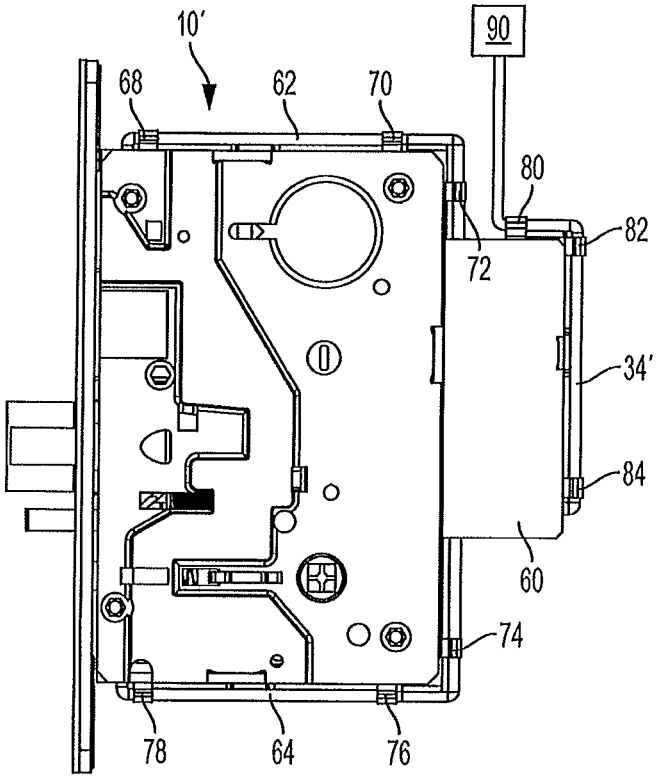
FIG. 6 is a left side elevational view of another embodiment of the present invention, with the configurable circuit with resistor network mounted in a circuit housing adjacent and electrically interconnected to the mortise lock.
Figure 7:
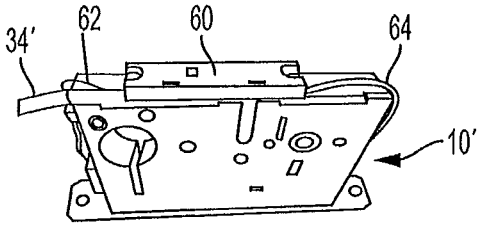
FIG. 7 is a perspective view of the embodiment of the present invention in FIG. 6, showing the circuit housing adjacent and electrically interconnected to the mortise lock.

FIGS. 6-9 depict another embodiment of the present invention, wherein the resistor network is embedded in a configurable circuit which is enclosed within a circuit housing mounted adjacent to the electronic lock body and electrically interconnected with the electronic door lock. Referring to FIGS. 6 and 7, a configurable circuit housing 60 is mounted adjacent to the electronic door lock body and is electrically interconnected with the electronic door lock 10' by internal wire harnesses 62, 64. Internal wire harnesses 62, 64 may be secured to the mortise lock by a plurality of cable clips, such as cable clips 68, 70, 72, 74, 76, and 78. Cable 34' leads to external unit 90, and the cable may send and/or receive signals passing between electrical components in the electronic door lock 10' and the external unit. Cable 34' may be secured to the configurable circuit housing 60 by a plurality of cable clips, such as cable clips 80, 82 and 84.

Figure 8:
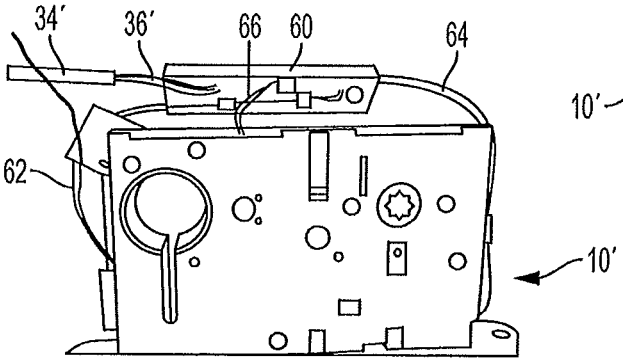
FIG. 8 is an exploded perspective view of FIG. 7, showing the internal lock wire harness connections between the configurable circuit mounted in a circuit housing and the mortise lock, as well as an external wire harness exiting the circuit housing which may be connected directly to an external unit, such as an access control panel, or may be attached to an intervening electrical connector.
Figure 9:
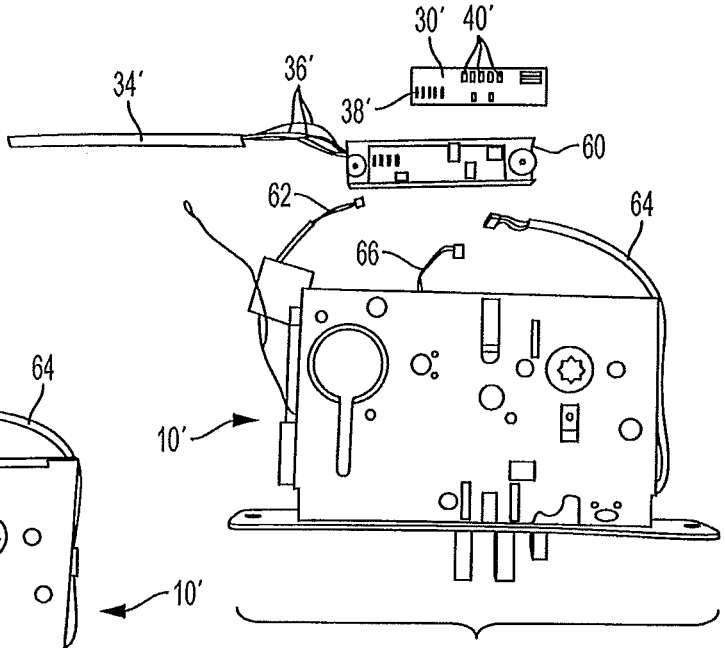
FIG. 9 is an exploded perspective view of FIG. 7, showing the configurable circuit board with resistor network of an embodiment of the present invention, the circuit housing, the internal lock wire harness connections between the configurable circuit and the mortise lock, as well as an external wire harness exiting the circuit housing.

Referring to FIGS. 8 and 9, a configurable circuit 30' is mounted within circuit housing 60 and electrically interconnected with electrical components within the mortise lock 10' by wires 36'. Configurable circuit board 30' may be identical to circuit board 30 or may be configured differently to meet a customer's specific requirements. Internal wire harnesses 62, 64, 66 electrically interconnect the configurable circuit 30' to electrical components within the mortise lock. By configuring the electrical connections provided on the configurable circuit board 30', different wires within cable 34' may be connected or not connected. Configuration may be achieved simply by connecting or not connecting wires 36' in cable 34' to corresponding solder points 38' on circuit board 30'. Alternatively, circuit board traces (not shown) on the circuit board 30' may be omitted or added to achieve configuration. Further, the circuit board 30' may be provided with various cross connections, or with additional electrical components to achieve configuration.

Additional electronic components may be mounted on the circuit board 30' to identify to circuitry in the lock and/or the external unit what type of electrical connector key has been installed and/or to signal that a valid and authorized electrical connector key has been installed, or to impart a desired load resistance which can be monitored by the external unit to determine its state. In the embodiment shown in FIGS. 8 and 9, resistors 40' have been embedded in the circuit board 30' which may optionally be configured as before to provide a desired load resistance which can be monitored by the external unit to determine changes to the resistance values established for one or more particular electronic components. By directly associating and locating the resistor network at the lock mechanism, rather than at the access control panel, it decreases the possibility of tampering with the line connecting the external unit to the electronic component.

The invention further provides an improved method of determining tampering of an access point. By integrating the resistor network within the electronic door lock body, or alternatively, directly associating and locating the resistor network at and adjacent the lock mechanism, and then monitoring load resistance adjacent to or within the electronic lock body to determine the state of the system at the external unit, a heightened security against tampering or defeating access control between the load panel and the access point is achieved.

The present invention therefore achieves one or more of the objects described above. It may reduce line vulnerability to tampering, cutting or shortening of a monitoring circuit between an access control panel and an access point at a door and electronic door lock. It may provide an improved integrated lock body system to prevent tampering between the load panel and the access point. It may provide heightened security against tampering or defeating access control by having the load resistance at the lock body. It may also ease and reduce installation time and labor costs for electronic door lock systems.

While the present invention has been particularly described, in conjunction with a specific embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An integrated lock body system for securing access points comprising:

an electronic door lock having a lock body, a plurality of electrical components within the lock capable of being monitored, and at least one output for connection to an external unit located remotely from the electronic door lock, the external unit adapted for monitoring load resistance between the external unit and the electronic door lock;

a selected one of a plurality of electrical connector keys being removably engageable with the electronic door lock body for electrically connecting selected components mounted within the electronic door lock, each electrical connector key having:

a connector key housing shaped to engage the electronic door lock, the connector key housing at least partially secured within the lock body when the electrical connector key engages the electronic door lock;

a lock side key connector mounted to the connector key housing for electrically connecting to the electronic door lock, the lock side key connector including a plurality of electrical connection points and being shaped to be received within and electrically connect to a mating lock connector mounted within an interior of the electronic door lock; and a circuit mounted within the connector key housing, the circuit including a plurality of electrical connection points for electrical connection to at least one selected component within the electronic door lock and an external electrical output for connection to the external unit, the circuit further including at least one resistor between one of the electrical connection points to the at least one selected component within the electronic door lock and the external electrical output, the at least one resistor imparting a desired load resistance between an output from the at least one selected component within the electronic door lock and the external unit, the plurality of electrical connector keys being differently configured to electrically connect to different selected components mounted within the electronic door lock; and the external unit in electrical communication with the electronic door lock and providing control and/or monitoring of the electronic door lock, the external unit adapted to monitor load resistance between the external unit and the electronic door lock to determine a state of the electronic door lock and to determine change to a resistance value established for the at least one selected component within the electronic door lock.

2. The integrated lock body system of claim 1 wherein the electronic door lock has a plurality of outputs for connection to the external unit.

3. The integrated lock body system of claim 1 wherein the circuit is a configurable circuit including a plurality of electrical connections extending from a selected set of electrical connection points within the electronic door lock to a selected set of external electrical outputs for connection to the external unit, the circuit including a plurality of resistors being able to be configured to impart a desired load resistance capable of being monitored by the external unit, wherein when the external electrical outputs are connected to the external unit, the plurality of electrical connections of the configurable circuit, the selected sets of the electrical connection points, and the external electrical outputs define a configured interconnection with a desired resistance load between the selected components within the electronic door lock and the external unit.

4. The integrated lock body system of claim 3 wherein the plurality of resistors are embedded in the circuit.

5. The integrated lock body system of claim 3 wherein the configurable circuit is positioned within a configurable circuit housing mounted adjacent to the electronic lock body and in electrical communication with the electronic door lock.

6. The integrated lock body system of claim 5 wherein the plurality of external electrical outputs for connection to the external unit comprise a plurality of wires and wherein selected wires are soldered at one end to the configurable circuit to define the selected set of the external electrical outputs.

7. The integrated lock body system of claim 1 wherein the circuit is mounted within the electronic lock body.

8. The integrated lock body system of claim 1 wherein the circuit is mounted adjacent to the electronic lock body.

9. The integrated lock body system of claim 1 wherein the connector key housing is shaped to snap into a mating opening in the electronic door lock.

10. The integrated lock body system of claim 1 wherein the plurality of external electrical outputs for connection to the external unit comprise a plurality of wires and wherein selected wires are soldered at one end to the configurable circuit to define the selected set of the plurality of external electrical outputs.

11. The integrated lock body system of claim 1 wherein the electrical connector key communicates with the electronic door lock to identify the electrical connector key as an authorized electrical connector key.

12. A method for determining tampering at an access point, the method comprising the steps of:

providing a plurality of electrical connector keys for electrically connecting selected components mounted within an electronic door lock, each electrical connector key having a connector key housing shaped to engage the electronic door lock; a lock side key connector mounted to the connector key housing for electrically connecting to the electronic door lock wherein the lock side key connector includes a plurality of electrical connection points and the lock side key connector is shaped to be received within and electrically connect to a mating lock connector mounted within an interior of the electronic door lock when the connector key housing engages the electronic door lock; and a circuit mounted within the connector key housing, the circuit including a plurality of electrical connection points for electrical connection to at least one selected component within the electronic door lock and an external electrical output for connection to an external unit, the circuit further including at least one resistor between one of the electrical connection points to the at least one selected component within the electronic door lock and the external electrical output, the at least one resistor imparting a desired load resistance between an output from the at least one selected component within the electronic door lock and the external unit, the plurality of electrical connector keys being differently configured to electrically connect to different selected components mounted within the electronic door lock;

providing at the access point the electronic door lock having a lock body and a plurality of electrical components within the lock capable of being monitored, and at least one output for connection to the external unit, the electronic door lock being capable of receiving a selected one of the differently configured electrical connector keys;

providing an external unit located remotely from the electronic door lock and adapted for control and/or monitoring of the electronic door lock, the external unit capable of monitoring load resistance between the external unit and the electronic door lock, the electronic door lock being in electrical communication with the external unit;

selecting one electrical connector key from among the plurality of differently configured electrical connector keys;

engaging the connector key housing with the mating lock connector of the electronic door lock to electrically connect the electronic door lock with the external unit; and monitoring load resistance of the at least one resistor in the circuit mounted within the connector key housing to determine a state of the electronic door lock at the external unit, and wherein the monitoring determines change to a resistance value established for at least one selected component mounted within the electronic door lock from among the different components.

13. The method of claim 12 wherein the circuit is a configurable circuit including a plurality of electrical connections extending from a selected set of electrical connection points within the electronic door lock to a selected set of external electrical outputs for connection to the external unit, the circuit including a plurality of resistors being able to be configured to impart a desired load resistance capable of being monitored by the external unit, and including configuring the circuit so that the plurality of electrical connections of the configurable circuit, the selected sets of the electrical connection points and the external electrical outputs define a configured interconnection with a desired resistance load between the selected components within the electronic door lock and the external unit.

14. The method of claim 13 wherein the plurality of resistors are embedded in the circuit.

15. The method of claim 13 wherein the electronic door lock has a plurality of outputs for connection to the external unit comprising a plurality of wires and wherein selected wires are soldered at one end to the configurable circuit to define the selected set of the plurality of external electrical outputs.

16. The method of claim 13 wherein the configurable circuit is positioned within a configurable circuit housing mounted adjacent to the electronic lock body and in electrical communication with the electronic door lock.

17. The method of claim 12 including mounting the circuit within the electronic lock body.

18. The method of claim 12 including mounting the circuit adjacent to the electronic lock body.

19. The method of claim 12 wherein the electrical connector key communicates with the electronic door lock to identify the electrical connector key as an authorized electrical connector key.

20. The method of claim 12 wherein the connector key housing is shaped to snap into a mating opening in the electronic door lock.

* * * * *